US005445703A

United States Patent [19]

Steeves et al.

[11] Patent Number: 5,445,703

[45] Date of Patent: Aug. 29, 1995

[54] MASKING TOOL

[76] Inventors: Lester A. Steeves, 463 Fralicks Beach Road, Port Perry, Ontario, Canada, L9L 1B6; Brian E. Steeves, 36 Delta Crescent, Holland Landing, Ontario, Canada, L0G 1H0

[21] Appl. No.: 173,003

[22] Filed: Dec. 27, 1993

Related U.S. Application Data

[63] Continuation-in-part of Ser. No. 986,934, Dec. 8, 1992.

[51] Int. Cl.[6] ..... B32B 31/00

[52] U.S. Cl. ..... 156/544; 156/527; 156/554; 156/577; 156/579; 225/33; 225/34

[58] Field of Search ..... 156/523, 527, 574, 577, 156/579, 544, 554; 225/33, 34, 37

[56] References Cited

U.S. PATENT DOCUMENTS

| | | | |
|---|---|---|---|
| Re. 30,787 | 11/1981 | Pool et al. | 156/527 |
| 776,950 | 12/1904 | Simpson | 156/577 |
| 2,100,652 | 11/1937 | Shimer | 216/23 |
| 2,487,061 | 11/1949 | Ptasnik | 225/34 |
| 2,710,152 | 6/1955 | Jones | 225/33 |
| 2,723,718 | 11/1955 | Bright | 225/33 |
| 3,148,813 | 9/1964 | Joyce | 225/33 |
| 3,152,032 | 10/1964 | Waltz | 156/554 |
| 3,173,590 | 3/1965 | Bohnsen | 225/33 |
| 3,950,214 | 4/1976 | Pool et al. | 156/527 |
| 4,508,587 | 4/1985 | Hunter | 156/527 |
| 4,588,469 | 5/1986 | Hunter | 156/527 |
| 4,667,891 | 5/1987 | Pool | 156/527 X |
| 4,913,767 | 4/1990 | Longworth | 156/554 X |
| 4,915,769 | 4/1990 | Heil et al. | 156/527 |
| 4,981,537 | 1/1991 | Heil et al. | 156/71 |

*Primary Examiner*—James J. Engel
*Attorney, Agent, or Firm*—Kenneth M. Garrett

[57] ABSTRACT

An appliance for forming and dispensing masking from a roll of masking paper and a roll of masking tape is suitably formed as a lightweight plastic molding having a compact profile. The appliance is generally symmetrical about a front to back plane whereby it is non-handed, so permitting the appliance to be oriented at all times in a preferred manner when the masking is applied to a surface.

20 Claims, 3 Drawing Sheets

MASKING TOOL

RELATED APPLICATIONS

This application is a continuation in part of Ser. No. 986,934 filed Dec. 08, 1992.

FIELD OF INVENTION

This invention relates to a simple manual appliance for dispensing and applying masking to a surface generally in preparation for painting. The term "masking" as used herein refers to a band of masking paper or the like of indefinite length with an overlapping band of masking tape applied along the length of the paper.

BACKGROUND OF INVENTION

Appliances for dispensing masking are disclosed in the following prior art:

| | | |
|---|---|---|
| U.S. Pat. No. | 3,787,271 | Wahlquist |
| U.S. Pat. No. | 3,950,214 | Pool et al |
| U.S. Pat. No. | 4,096,021 | Pool et al |

Each of the disclosed appliances include a frame, and mounted therefrom a paper roll holder, a tape roll hold and a handle, and optionally a masking guide locating forwardly of the paper roll holder. The disclosed appliances are all handed, which is to say that they are devoid of symmetry. The effect of this is that for certain applications, for example where the masking is to be applied along an inside vertical corner of a room, if the applicator is suited for applying the masking to the corner in a downward movement, it will be unsuited for applying the masking to the corner in an upward movement.

The masking will be generally withdrawn from the appliance in a plane defined by a masking support bar, which is disposed forwardly of the paper roll, over which bar the masking passes as it is dispensed from the appliance. Where the handle of the appliance is significantly offset from this plane a torque is developed as the masking is dispensed, which leads to operator fatigue.

The prior art appliances are suited for construction from metal, with relatively long paper roll holders and masking guides cantilevered outwardly from the frame. Such appliances are relatively heavy and are not readily adapted for molding in thermo plastic materials.

The prior an appliances tend to be relatively bulky whereby they are not entirely suited for use in confined spaces.

SUMMARY OF THE INVENTION

It is an object of this invention to provide a manual appliance for forming and dispensing masking that may be non-handed.

It is another object of this invention to provide a manual appliance for forming and dispensing masking that is suited for manufacture from plastic materials.

It is still another object of this invention to provide a manual appliance for forming and dispensing masking that is relatively compact and lightweight.

It is yet another object of this invention to provide a manual appliance for forming and dispensing masking that reduces operator fatigue.

In accordance with the broad aspects of the invention, a manual appliance for forming and dispensing masking from masking paper and masking tape separately stored on rolls comprises a frame which is defined by a rear wall, a front wall and a pair of side walls connecting the rear wall and from wall in a generally rectangular arrangement. A masking paper roll holder having an axis therealong extends within the frame between the two side walls, parallel to the front wall. The front wall serves as a guide for the masking being dispensed from the appliance, and has masking severing means associated therewith, suitably in the form of a stationary serrated cutting edge. A handle including a handle portion having an axis therealong is associated with the rear wall, and may suitably comprise a minor portion of the rear wall which is rearwardly offset from the major portion thereof. A masking tape roll holder is normally supported from the frame rearwardly of the rear wall. The front wall, the axis of the masking paper roll holder and the axis of the handle are all contained in a thick plane, and for most purposes, at least insofar as a user of the appliance is concerned, the front wall, the handle and the paper roll holder will appear to have a common plane of symmetry contained within the thick plane. This apparent symmetry permits the use of the appliance in both a left handed and a right handed manner. Additionally, in such appliance the masking will normally be withdrawn therefrom in a plane within the thick plane or close thereto. Accordingly, the disposition of the handle within this plane reduces operator fatigue resulting from torque forces generated at the handle.

The axis handle of the appliance preferably extends parallel to the axis of the paper roll holder, and the handle suitably forms an integral part of the rear wall, and the frame including the handle and a support bracket forming a part of the masking tape roll holder may be unitarily formed as a plastic molding. This substantially reduces the weight of the appliance without detrimental effect on the rigidity, further contributing to a reduction in operator fatigue while permitting the accurate positioning of masking dispensed from the appliance.

In accordance with one embodiment, the front wall, i.e. the masking guide, is provided with a slot therealong disposed in the plane containing the axis of the handle and paper roll holder extending continuously to adjacent each side wall, through which the masking is dispensed, and has tooth like serrations on opposed sides of the slot to form the masking severing means.

These foregoing objects and aspects of the invention, together with other objects, aspects and advantages thereof will be more apparent from the following description of a preferred embodiment thereof, taken in conjunction with the following drawings.

IN THE DRAWINGS

FIG. 1—shows in perspective, exploded view the appliance of the invention, together with a roll of masking tape and masking paper; broken away to reveal detail;

FIG. 2—shows the appliance of FIG. 1, assembled and in use, in perspective view, rotated through 180° out of the plane of paper in relation to FIG. 1;

FIG. 3—is a view on line 3—3 of FIG. 1;

FIG. 4—shows in perspective exploded view a modified version of the frame portion of the appliance; and FIG. 5—is a view on line 5—5 of FIG. 4.

DESCRIPTION OF THE PREFERRED EMBODIMENT

Figures 1, 3:
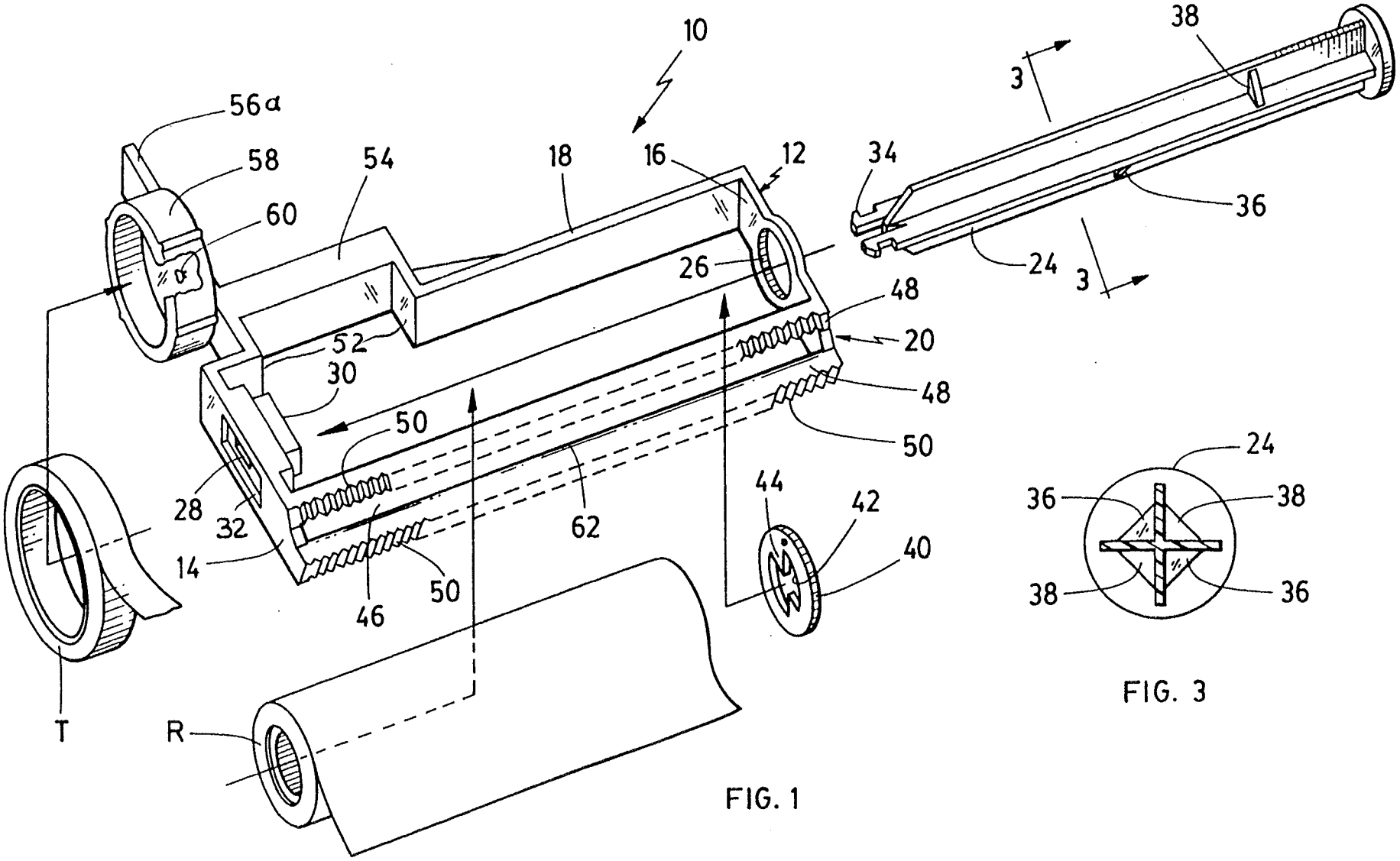

Referring to the drawings in detail, a masking forming and dispensing appliance in accordance with the invention is identified therein generally by the numeral 10. Appliance 10 comprises a generally rectangular frame 12 including four wail portions, namely a first side wall 14, second side wall 16, a rear wall 18 and front wall 20.

Each of walls 14, 16, 18, 20 has a generally similar height whereby frame 12 may be considered to reside in a thick plane. Walls 18 and 20 along the length thereof are considered to define the axial direction of frame 12. A paper roll holder 24 extends between side walls 14, 16 and is releasably supported thereby, for which purpose side wall 16 is provided with a central circular opening 26 therethrough, through which paper roll holder 24 will pass snugly, and side wall 14 is provided with a rectangular opening 28 therethrough concentred with opening 26. Opening 28 is surrounded on the inner side of wall 14 by an inwardly projecting boss 30, and on the outer side of wall 14 by a recess 32. Holder 24 is provided at one axial end thereof with a pair of legs having hooked ends 34 which snap fit through opening 28 without projecting outwardly of recess 32, to releasably retain holder 24 in a non-rotatable relationship in frame 12. Holder 24 has a cruciform cross section; first and second pairs of diametrically opposed stop shoulders 36,38 are axially spaced apart on holder 24, shoulders 38 being rotated through 90° in relation to shoulders 36. A stop collar 40 having an opening 42 therethrough restricted by a pair of diametrically opposed triangular tabs 44 is slidable along holder 24 until tabs 44 abuts stop shoulders 36, or if rotated through 90°, stop shoulders 38.

With stop collar 40 positioned on holder 24 in abutment with stop shoulders 36, and holder 24 secured to frame 12, the distance between boss 30 and stop collar 40 will be equal to the standard width of a roll R of masking paper; when stop collar 40 is adjusted to be in abutment with stop shoulders 38, the distance will be equal to a different standard width roll, and with the stop collar removed, the distance between boss 30 and side wall 16 will be equal to that of still another standard width roll.

Front wall 20 has a slot 46 therethrough at mid height extending continuously to adjacent each side wall 14,16, a plane containing slot 46 bisecting frame 12 and containing the geometric axis of holder 24.

Slot 46 serves to divide wall 20 into two opposed jaws 48 one of which is more forwardly disposed than the other. The forward face of each of jaws 48 is forwardly inclined towards slot 46, and is provided with tooth like serrations 50 therealong.

Appliance 10 further includes a handle 54 and handle arms 56 which connect to rear wall 18 on opposed sides of a lacuna 52 formed in the rear wall adjacent side wall 14. One of the handle arms 56 extends rearwardly of handle 54 in a portion **56*a*, to which extension a tape roll holder 58 is rotationally connected by a pivot 60. The plane containing slot 46 also contain the geometric axis of handle 54**.

Considering now the operation of appliance 10, and with specific reference to FIG. 1 wherein tape roll holder 58 locates at the left hand side of the appliance, as viewed from a forward direction, paper roll R is engaged on paper roll holder 24 as the latter is urged through opening 26 towards the left hand side of frame 12, with stop collar 40 suitably located on holder 24 as earlier described, or omitted therefrom as the case may be, according to the width of paper roll R, so that when holder 24 is snapped into position roll R will be free to rotate on the holder, but will be retained in a fixed axial position. The leading edge L of masking paper from roll R is threaded manually through slot 46 in a manner to exit forwardly therefrom, the forward offset of one of jaws 48 from the other facilitating the threading. The threading is further facilitated by rounding jaws 48 at 62 at the rearward entrance to slot 46. A roll of masking tape T is engaged on tape roll holder 58, it being noted that the masking tape T and paper roll R are both positioned in a manner to unwind in the same rotational sense from the top of the respective rolls. The axial offset of arm 56 earlier spoken of will be such that masking tape from roll T overlaps the left hand margin of the masking paper from roll R, as will be appreciated best from FIG. 2, to form a composite masking M for application to a surface. When a sufficient length of masking M has been dispensed, it may be severed by either of jaws 48 by a upward or downward movement of jaws 48, as is convenient. During the severing operation and at other times it is often desirable to prevent masking paper roll R from turning, or to provide a frictional resistance to turning, and handles 54 is disposed on frame 12 whereby when the handle is grasped by the hand H of a user during normal operation, as seen in FIG. 2, one or more fingers of that hand may extend to about the geometric axis of roll R whereby a suitable braking resistance may be provided by the fingers.

The appliance 10 having the orientation shown in FIG. 1 will be best suited for applying meshing M in a downward direction in a corner at to the right of a user, and is considered to be set up for right handed operation. By contrast, the appliance as seen in FIG. 2 is set up for left handed operation in which meshing may be applied in a downward direction to a corner on the left hand side of the operator. For most intents and purposes, appliance 10 when set up for right handed operation will appear to a user to be the mirror image of the appliance when set up for left handed operation.

Figure 2:
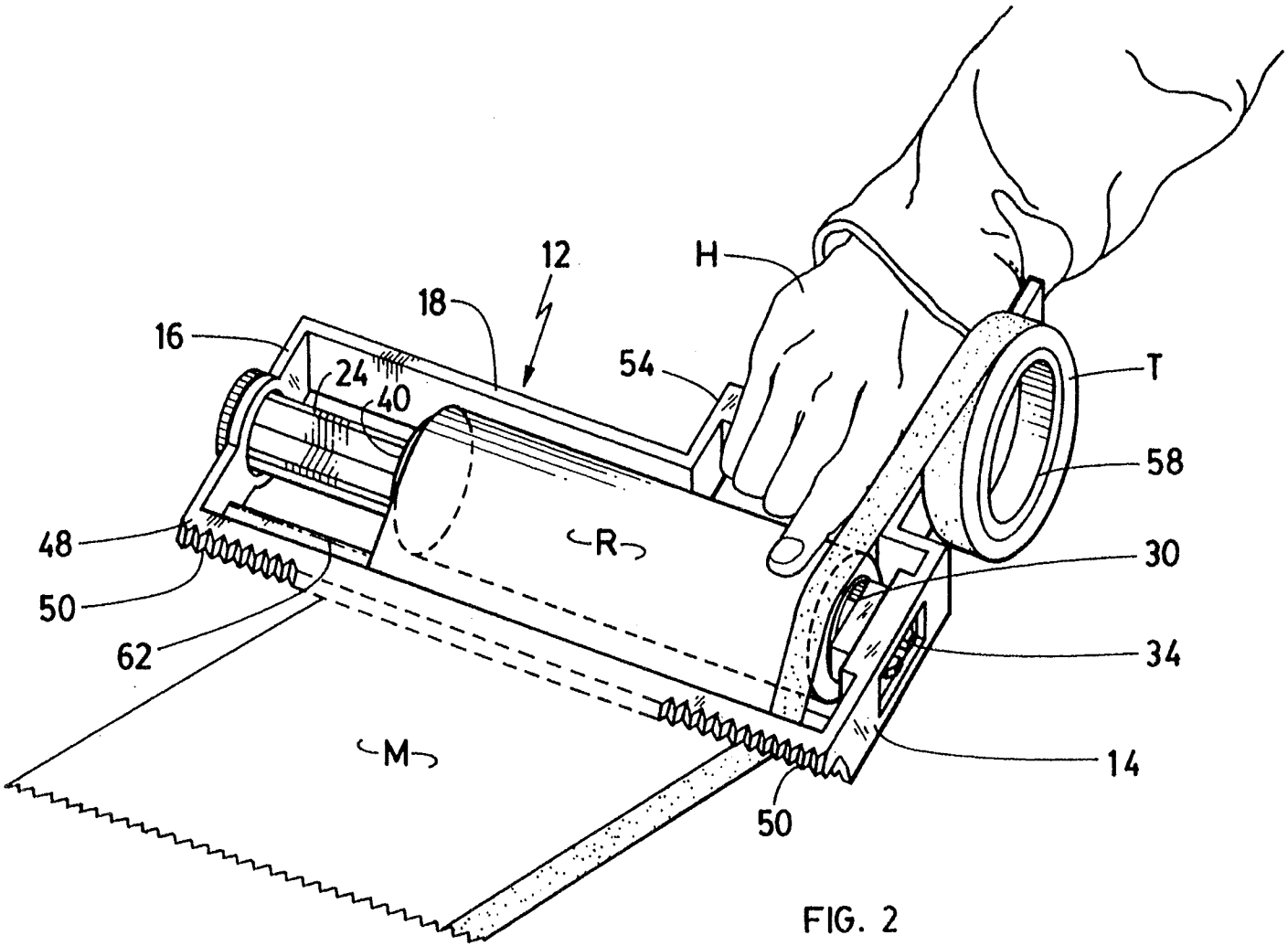
Figure 4:
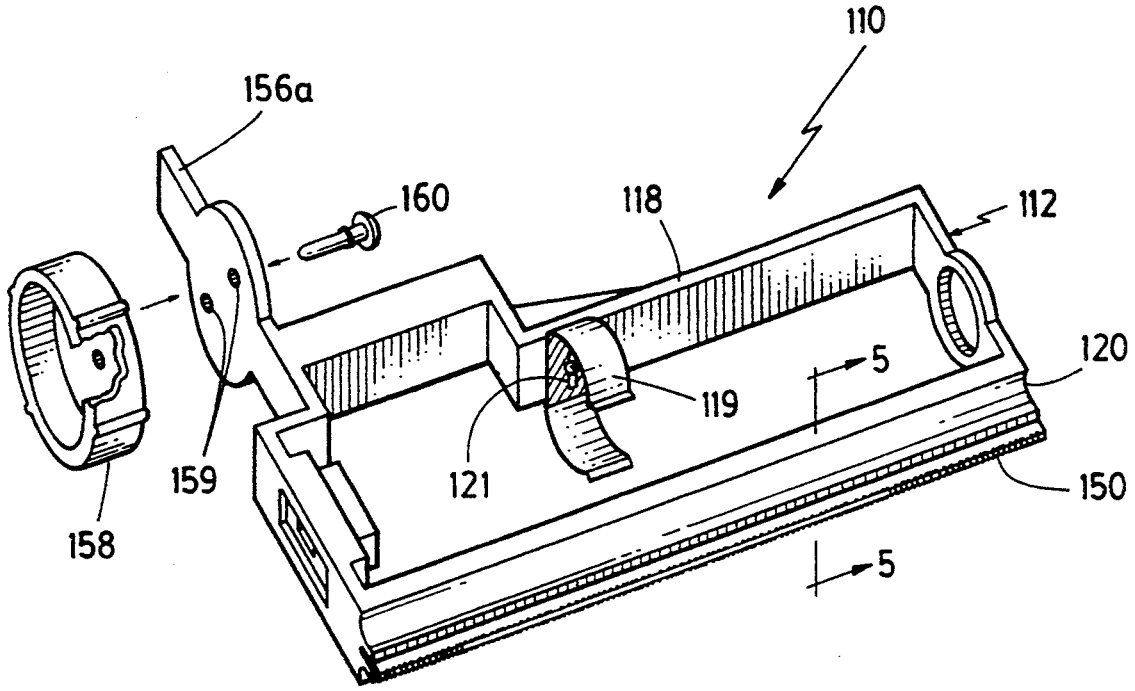
Figure 5:
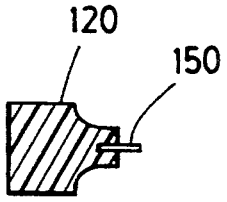

With reference to FIGS. 4 and 5, which illustrate certain modifications to the frame portion of the appliance 10 of FIGS. 1 to 3, similar parts are identified where necessary by similar numerals to those earlier employed, augmented by 100. Thus frame 112 comprises a rear wall 118, to which is secured a spring finger 119 that will exert a frictional force on a masking paper roll R. An adjustment screw 121 permits the spring finger 119 to be moved in a manner to adjust the spring finger for right and left handed use of the appliance. In this embodiment, arm extension **156*a* is somewhat enlarged and two openings 159 are provided through either of which openings a pivot pin 160 may be inserted to retain tape roll holder 158 in either of two positions on frame 112. It will be appreciated that should it be desired, more openings 159 could be provided in arm extension 156*a* to provide more positions for securing tape roll holder 158**.

The front wall 120 of frame 112 is reduced in height adjacent the forward end thereof, and is provided with a cutting edge 150 therealong which is suitably in the form of a metal insert. Since frame 112 is symmetric about a plane containing cutting edge 150, the masking will be dispensed beneath front wall 120 in an identical manner irrespectively of whether frame 112 is oriented as illustrated or flipped over side for side for left handed operation.

It will be apparent that many changes may be made to the illustrative embodiment while falling within the scope of the invention, and it is intended that all such changes be covered by the claims appended hereto.

We claim:

1. A manual appliance for forming masking from masking tape and masking paper separately stored on rolls and applying said masking to a surface with equal facility in opposed directions, said appliance comprising a generally rectangular frame defined by a rear wall, a front wall and a pair of side walls;

a masking paper roll holder having an axis therealong extending between said pair of side walls within said frame;

masking severing means associated with said front wall;

handle means associated with said rear wall, said handle means including a handle having an axis therealong;

said paper roll holder axis, and said handle axis being disposed in a plane passing through said masking severing means along the length thereof; and a masking tape roll holder, and means for supporting said masking tape roll holder from said frame.

2. The appliance of claim 1 wherein said masking severing means includes a slot extending continuously through said front wall along the length thereof to adjacent each said side wall, and a cutting edge is disposed on opposed sides of said slot, and wherein said plane passes through said slot.

3. The appliance of claim 2 wherein said front wall where it extends along one side of said slot is more forwardly located than said front wall where it extends along the opposed side of said slot.

4. The appliance of claim 1 wherein the axis of said handle is parallel to the axis of said paper roll holder.

5. The appliance of claim 4 wherein said rear wall is provided with a lacuna and wherein said handle means includes a handle and a pair of handle support walls which connect to said rear wall on opposed sides of said lacuna.

6. The appliance of claim 4 wherein one of said handle support walls is rearwardly extended beyond said handle to provide said means for supporting said masking tape roll holder.

7. The appliance of claim 1 including spring finger means supported from said frame for exerting a frictional force on a paper roll when disposed on said paper roll holder.

8. The appliance of claim 1 wherein said paper roll holder is supported from said pair of side walls by means which permit the withdrawal of said paper roll holder from said frame.

9. The appliance as defined in claim 8 wherein said frame including said handle means is formed as a unitary plastic molding.

10. The appliance as defined in claim 8 wherein said paper roll holder support means includes resilient hook means disposed on said paper roll holder and an opening provided in one side wall of said pair of side walls into which said hook means is receivable so as to be self latching as said roll holder is moved towards its supported position.

11. An appliance as defined in claim 10 wherein said resilient hook means is unitarily formed with said paper roll holder.

12. An appliance as defined in claim 10 wherein said opening is surrounded by a recess within which a hook portion of said hook means is totally contained when said paper roll holder is engaged with said frame.

13. An appliance as defined in claim 1 wherein said paper roll holder is provided with a plurality of stop shoulders axially and rotationally spaced apart thereon, and including a stop collar slidable along said paper roll holder into abutment with preselected ones of said stop shoulders.

14. An appliance as defined in claim 10 wherein said paper roll holder has a cruciform cross section, and said stop shoulders comprise a first and second pair of diametrically opposed shoulders, one of said pair of shoulders being rotated through 90° with respect to the other of said pair of shoulders.

15. The appliance of claim 1 having a plane of symmetry coincident with said plane containing said paper roll axis and said handle axis.

16. The appliance of claim 1 wherein said means for supporting said masking tape roll holder is adapted to support said masking tape roll holder at a plurality of angularly preselectable positions relative to said paper roll holder.

17. A manual appliance for forming masking from masking tape and masking paper separately stored on rolls and applying said masking to a surface with equal facility in opposed directions, said appliance comprising a generally rectangular frame defined by a rear wall, a front wall and a pair of side walls;

a masking paper roll holder having an axis therealong extending between said pair of side walls within said frame;

masking severing means associated with said front wall;

handle means associated with said rear wall, said handle means including a handle having a axis therealong;

a plane containing said paper roll axis passing through said masking severing means along the length thereof and generally bisecting each one of said handle means and said frame;

a masking tape roll holder, and means for supporting said masking tape roll holder from said frame.

18. The appliance of claim 17 wherein said frame including said handle means is formed as a unitary plastic molding.

19. The appliance of claim 17 wherein said masking severing means comprises a metal cutting edge.

20. The appliance of claim 17 wherein said paper roll holder is supported from said pair of side walls by means which permit the withdrawal of said paper roll holder from said frame.

* * * * *